US010589162B2

(12) United States Patent
Koo

(10) Patent No.: US 10,589,162 B2
(45) Date of Patent: Mar. 17, 2020

(54) SPORTS BALL WITH SENSORS AND TRANSMITTER

(71) Applicant: Jason Koo, Manhattan Beach, CA (US)

(72) Inventor: Jason Koo, Manhattan Beach, CA (US)

( * ) Notice: Subject to any disclaimer, the term of this patent is extended or adjusted under 35 U.S.C. 154(b) by 0 days.

(21) Appl. No.: 15/836,378

(22) Filed: Dec. 8, 2017

(65) Prior Publication Data

US 2018/0161656 A1 Jun. 14, 2018

Related U.S. Application Data

(60) Provisional application No. 62/431,747, filed on Dec. 8, 2016.

(51) Int. Cl.

| | |
|---|---|
| ***A63B 69/36*** | (2006.01) |
| ***A63B 43/00*** | (2006.01) |
| ***A63B 37/00*** | (2006.01) |
| ***A63B 71/06*** | (2006.01) |
| ***A63B 57/20*** | (2015.01) |
| ***A63B 24/00*** | (2006.01) |
| ***A63B 69/00*** | (2006.01) |
| ***A63B 43/06*** | (2006.01) |
| ***A63B 57/00*** | (2015.01) |
| ***A63B 71/00*** | (2006.01) |

(52) U.S. Cl.

CPC ..... *A63B 69/3658* (2013.01); *A63B 24/00* (2013.01); *A63B 37/00* (2013.01); *A63B 37/0003* (2013.01); *A63B 43/00* (2013.01); *A63B 43/06* (2013.01); *A63B 57/00* (2013.01); *A63B 57/20* (2015.10); *A63B 69/00* (2013.01); *A63B 69/36* (2013.01); *A63B 71/00* (2013.01); *A63B 71/06* (2013.01); *A63B 2024/0053* (2013.01); *A63B 2220/12* (2013.01); *A63B 2220/35* (2013.01); *A63B 2220/40* (2013.01); *A63B 2220/833* (2013.01); *A63B 2225/20* (2013.01); *A63B 2225/54* (2013.01)

(58) Field of Classification Search
None
See application file for complete search history.

(56) References Cited

U.S. PATENT DOCUMENTS

| | | | |
|---|---|---|---|
| 7,219,033 | B2 | 5/2007 | Kolen |
| 7,689,378 | B2 | 3/2010 | Kolen |

(Continued)

*Primary Examiner* — Paula A D'Agostino
(74) *Attorney, Agent, or Firm* — QuickPatents, LLC; Kevin Prince

(57) ABSTRACT

A sports ball for communicating to an external electronic device various parameters related to an impact with a sporting implement, such as a golf club. The sports ball comprises an outer resilient shell within that is contained a resilient core. An electronic circuit comprises at least one sensor, a transmitter, optionally a light-emitting diode, and a power source. The electronic circuit is cushioned from the impact of the sporting implement by the resilient core. The electronic circuit is adapted for communicating sensor data to the external electronic device via the transmitter. The at least one sensor is taken from the group of sensors comprising: a GPS receiver, a multi-axis accelerometer, an orientation sensor, an altitude sensor, and a microphone. The transmitter may be an RFID chip that passively transfers data from the at least one sensor and a unique ID number of the sports ball.

14 Claims, 6 Drawing Sheets

(56) References Cited

U.S. PATENT DOCUMENTS 7,946,926 B1* 5/2011 Balardeta ..... A63B 69/3623 473/222
7,978,081 B2 7/2011 Shears
8,192,295 B2 6/2012 Rankin
8,257,189 B2 9/2012 Koudele
8,460,120 B1 6/2013 Azimi
8,801,529 B2 8/2014 Koudele
8,905,855 B2 12/2014 Fitzpatrick
9,032,794 B2 5/2015 Perkins
9,283,461 B2 3/2016 Parke
9,427,624 B2 8/2016 Molyneux
9,440,127 B2 9/2016 Boggs
9,457,251 B2 10/2016 Thurman
2002/0123386 A1* 9/2002 Perlmutter ..... A63B 24/0021 473/223
2005/0259002 A1* 11/2005 Erario ..... A63B 24/0021 342/357.61
2006/0148590 A1* 7/2006 Sullivan ..... A63B 37/0003 473/371
2007/0275787 A1 11/2007 Bouchard
2008/0207357 A1* 8/2008 Savarese ..... A63B 24/0021 473/407
2008/0284650 A1 11/2008 MacIntosh
2009/0017944 A1 1/2009 Savarese
2009/0029754 A1* 1/2009 Slocum ..... A63B 24/0087 463/5
2010/0151955 A1 6/2010 Holden
2010/0277617 A1* 11/2010 Hollinger ..... H04N 5/2252 348/231.99
2010/0285903 A1* 11/2010 Nicodem ..... A63B 37/0003 473/404
2012/0077608 A1 3/2012 Rankin
2012/0142443 A1* 6/2012 Savarese ..... A63B 71/06 473/199
2012/0244969 A1* 9/2012 Binder ..... A63H 33/18 473/570
2012/0270671 A1 10/2012 Ko
2013/0068017 A1 3/2013 Perkins
2013/0144411 A1* 6/2013 Savarese ..... G06F 17/40 700/91
2013/0196789 A1* 8/2013 Kim ..... A63B 37/0082 473/373
2013/0203518 A1* 8/2013 Hatton ..... A63B 53/047 473/223
2013/0210563 A1* 8/2013 Hollinger ..... H04N 5/2252 473/570
2013/0250047 A1* 9/2013 Hollinger ..... H04N 5/2252 348/36
2013/0274040 A1* 10/2013 Coza ..... G09B 19/0038 473/570
2013/0303314 A1 11/2013 Tackett
2014/0195022 A1 7/2014 Thurman
2014/0260637 A1* 9/2014 Molinari ..... G01P 9/00 73/646
2014/0266160 A1* 9/2014 Coza ..... G01B 7/003 324/207.11
2015/0105172 A1* 4/2015 Thurman ..... A63B 69/3658 473/199
2015/0105173 A1* 4/2015 Thurman ..... G09B 19/0038 473/199
2016/0001136 A1 1/2016 King
2016/0151696 A1 6/2016 Chen
2016/0279471 A1* 9/2016 Holzapfel ..... G08B 13/1427
2016/0303443 A1* 10/2016 Boggs ..... A63B 53/10
2016/0317896 A1* 11/2016 Albelo ..... A63B 69/3614

* cited by examiner

SPORTS BALL WITH SENSORS AND TRANSMITTER

CROSS-REFERENCE TO RELATED APPLICATIONS

This application claims the benefit of U.S. Provisional Patent Application 62/431,747, filed on Dec. 8, 2016, and incorporated herein by reference.

STATEMENT REGARDING FEDERALLY SPONSORED RESEARCH AND DEVELOPMENT

Not Applicable.

FIELD OF THE INVENTION

This invention relates to sports balls, and more particularly to a sports ball having internal sensors and a transmitter.

DISCUSSION OF RELATED ART

It is generally considered important for athletes to receive feedback on their performance in order to improve, and that is particularly true in the sport of golf. While golfing it is very easy to slice or hook the ball with only minute changes in club position during the golf swing. Further, it is easy to lose one's ball and thereby lose feedback of how far the ball was hit and perhaps in what direction and with what type of spin.

RFID tags and circuits are known to be used with certain types of driving ranges that provide nearly instant feedback to the golfer as to the distance the ball was hit, what target was hit, and even a portion of the target that was hit. Such driving ranges include RFID transceivers that poll the ball when entering a target to obtain a ball serial number, which is known to be hit from a particular hitting location to which the ball was dispensed before being hit. However, a ball with an RFID tag alone is unable to provide feedback on performance parameters such as ball impact force, ball spin and spin direction during flight, distance hit to first impact with the ground surface, flight time of the ball after impact, rolling distance after landing, and the like.

Therefore, there is a need for a sports ball that provides such performance parameters after each hit of the ball. Such a needed invention would be durable and able to withstand impacts from a golf club or other sporting implement without damaging electronic circuits and sensors within. Further, such a needed device would be water impervious and capable of transmitting its position to a user's smart phone or other device. The present invention accomplishes these objectives.

SUMMARY OF THE INVENTION

The present device is a sports ball for communicating to an external electronic device various parameters related to an impact of the sports ball by a sporting implement, such as a golf club, a baseball bat, a tennis racquet, or the like.

The sports ball comprises an outer resilient, water-impervious shell within which is contained a resilient core that preferably comprises an outer core and an inner core. The inner core is preferably more resilient than the outer core to absorb the impact of the sporting implement.

An electronic circuit preferably comprises at least one sensor, a transmitter, optionally a light-emitting diode, and a power source. The electronic circuit is cushioned from the impact of the sporting implement by the resilient core. The light-emitting diode is fixed proximate the shell and adapted to illuminate through the shell to indicate states of the electronic circuit. In such an embodiment, the resilient shell is non-opaque.

The electronic circuit is adapted for communicating sensor data to the external electronic device via the transmitter. The at least one sensor is taken from the group of sensors comprising: a GPS receiver, a multi-axis accelerometer, an orientation sensor, an altitude sensor, and a microphone. The transmitter may be an RFID chip that passively transfers data from the at least one sensor and a unique ID number of the sports ball.

All of the sensors may be fixed with a circuit board and incorporated into a single package suitable for sustaining large G-forces, or may be distributed throughout the inner core with resilient and durable wiring. Regardless, the electronic circuit and its components are preferably positioned within the resilient core such that the center of gravity of the electronic circuit coincides with the center of gravity of the shell and resilient core, such that wobbling of the sports ball while in flight is minimized.

The sports ball may be used in a driving range-type application wherein the transmitter is an RFID circuit that transmits its ID and sensor data to receiving antennas in the driving range field of play. Such driving ranges typically provide feedback to the user as to the distance the ball was hit and what target in the range was hit. Sensor data from the at least one sensor may also include measurements of spin speed and direction, peak height, and air hang-time, for example.

On a golf course, upon the external electronic device becoming within range of the transmitter of the electronic circuit, the sports ball can report its position, distance hit, a measurement of spin speed and direction of the sports ball, peak height, air flight-time, type of surface hit with the sports ball upon landing, roll distance after landing, swing strength, and the like.

The present device is a sports ball that provides performance parameters after each hit of the ball, such as distance hit, ball impact force with the sporting implement, ball spin and spin direction during flight, distance hit to first impact with the ground surface, flight time of the ball after impact, rolling distance after landing, and the like. Such a needed invention would be durable and able to withstand impacts from a golf club or other sporting implement without damaging electronic circuits and sensors within. Further, such a needed device would be water impervious and capable of transmitting its position to a user's smart phone or other device. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
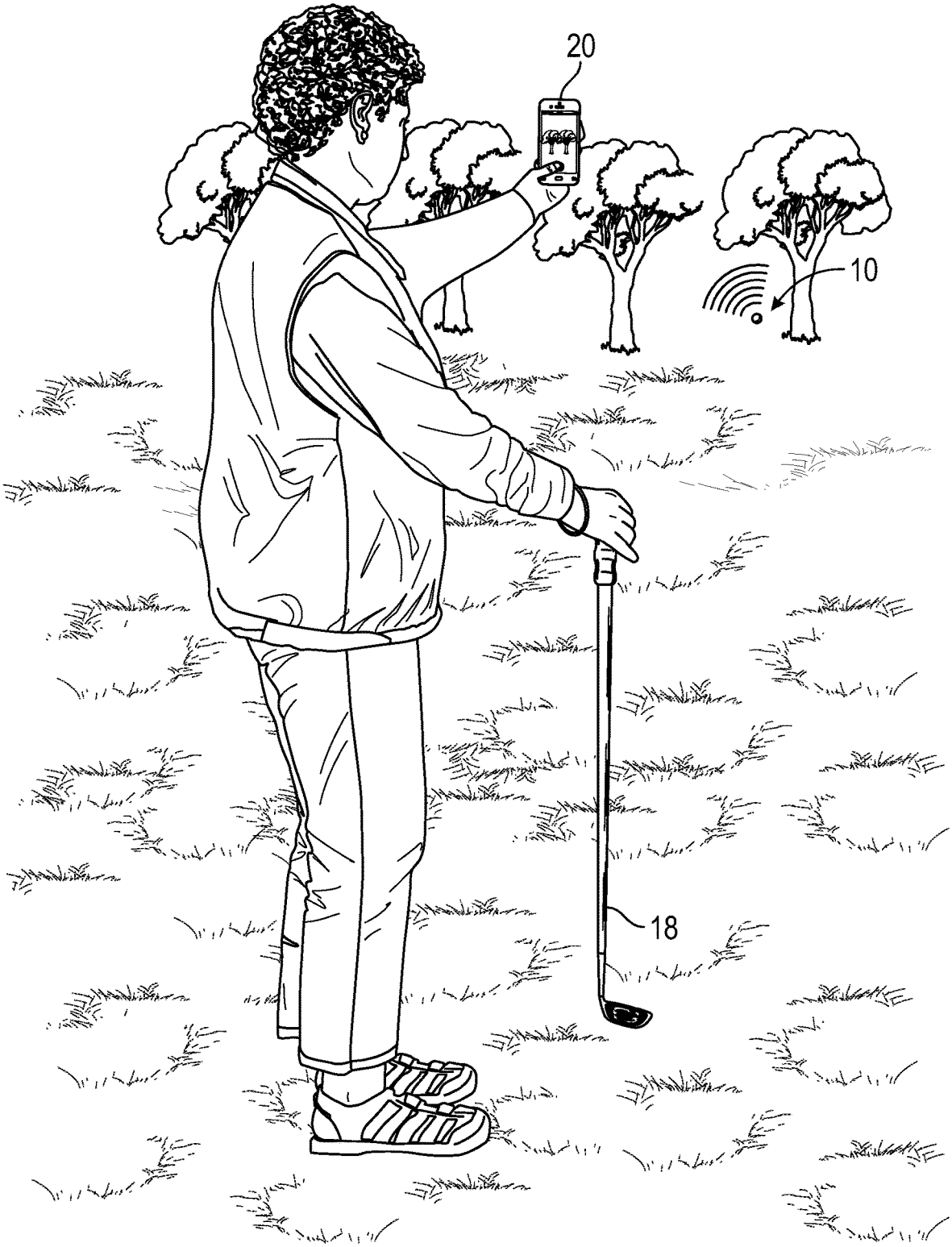
FIG. 1 is a perspective view of a user and an external electronic device utilizing the sports ball of the present invention, as embodied in a golf ball.
Figure 2:
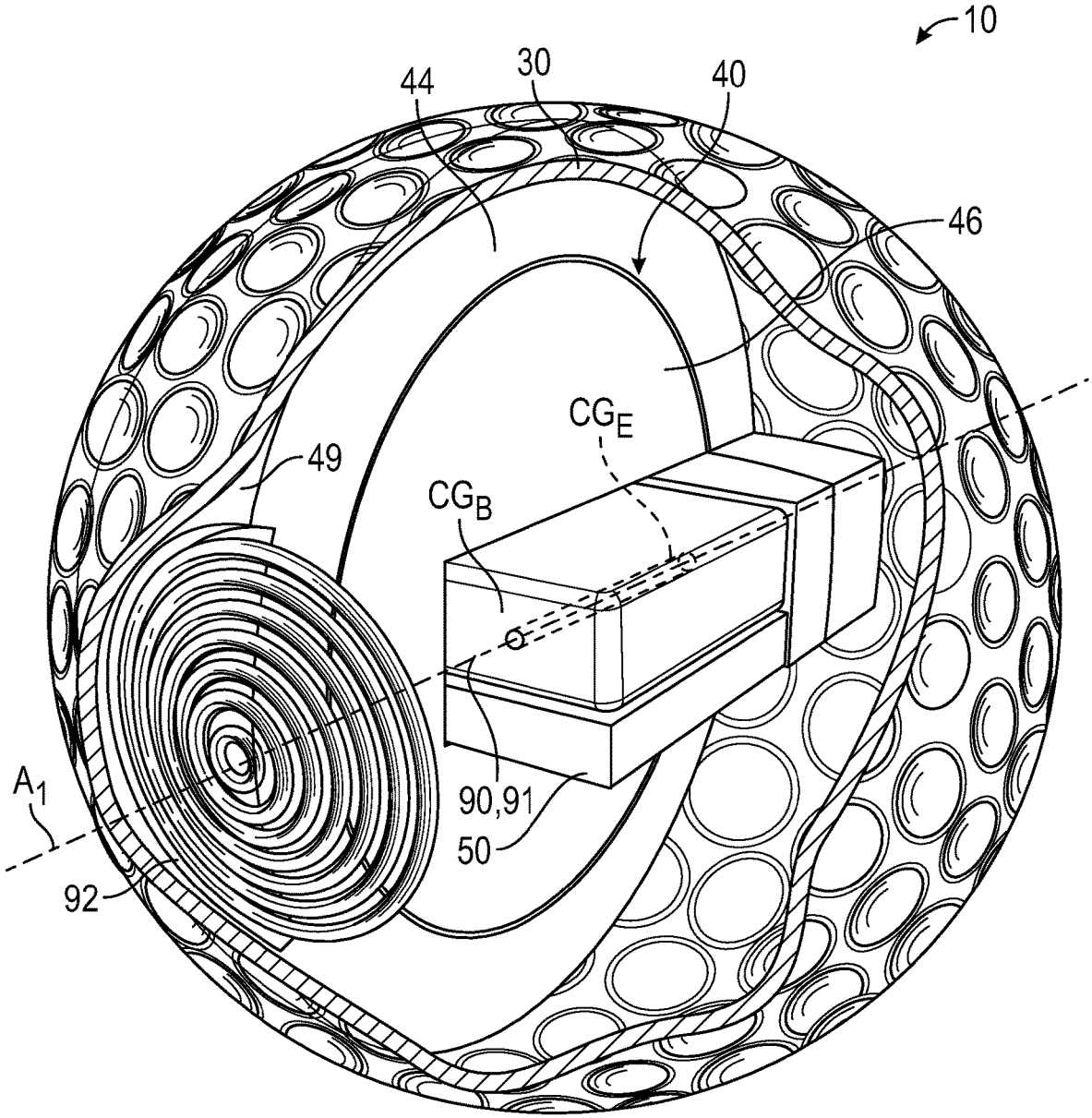
FIG. 2 is a front perspective, cut-away view of the sports ball.
Figure 3:
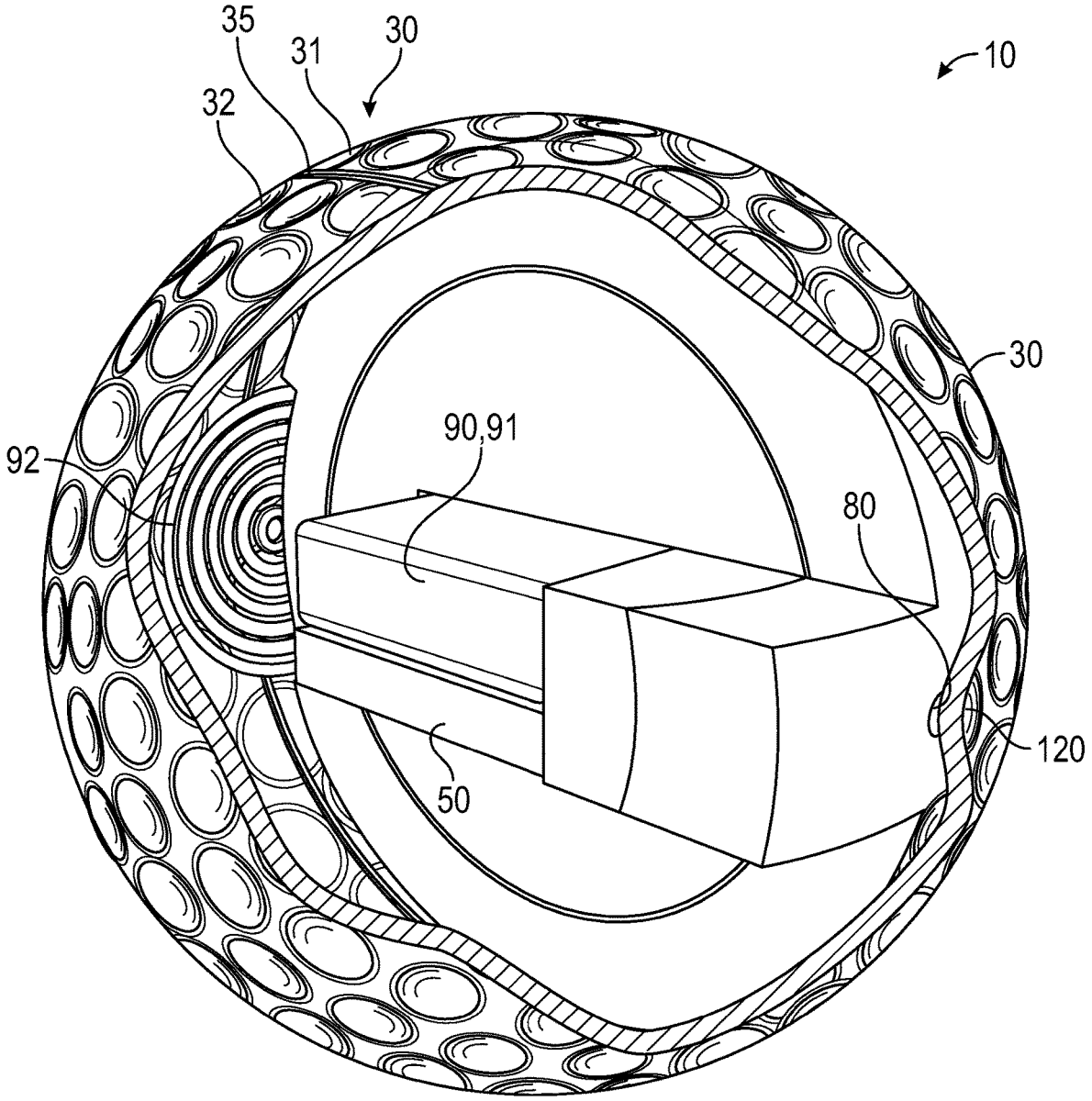
FIG. 3 is a rear perspective view of the sports ball of FIG. 2.

FIGS. 1-3 illustrate a sports ball 10 for communicating to an external electronic device various parameters related to an impact of the sports ball 10 by a sporting implement 18, such as a golf club, a baseball bat, a tennis racquet, or the like. Such an external electronic device may be a remote antenna connected with a scoring computer, a smart phone, a tablet computer, or the like.

The sports ball 10 comprises an outer resilient, water-impervious shell 30 within which is contained a resilient core 40 that preferably comprises an outer core 44 and an inner core 46. The inner core 44 is preferably more resilient than the outer core 46 to absorb the impact of the sporting implement 18. Preferably the inner core includes a silicon rubber material, or the like. A compression rating of the sports ball 10 in the embodiment of a golf ball, using Majestix or Atti measurement devices, is preferably in the range of 86-112. Preferably such a sports ball has a cover hardness of between 48.2/n and 68.8/n (Shore D), and 77-98 (Shore C).

An electronic circuit 50 (FIGS. 2-4) preferably comprises at least one sensor 60, a transmitter 70, optionally a light-emitting diode 80, and a power source 90. The electronic circuit 50 is cushioned from the impact of the sporting implement 20 by the resilient core 40. The light-emitting diode 80 is fixed proximate the shell 30 and adapted to illuminate through the shell 30 to indicate states of the electronic circuit 50. In such an embodiment, the resilient shell 30 is non-opaque.

The electronic circuit 50 is adapted for communicating sensor data to the external electronic device 20 via the transmitter 70. The at least one sensor 60 is taken from the group of sensors comprising: a GPS receiver or other geolocation sensor 61, a multi-axis accelerometer 62, an orientation sensor 63, an altitude sensor 64 such as a barometer, a temperature sensor (not shown), and a microphone 65. The transmitter 70 may be an RFID chip that passively transfers data from the at least one sensor 60 and a unique ID number (not shown) of the sports ball 10.

The GPS receiver 61 is adapted to receive GPS signals from GPS satellites (not shown) for determining through calculation the position of the sports ball 10 on earth, and for determining timing attributes of the impact with the sporting implement 18 in conjunction with the other sensors 60, including air-time (the amount of time the sporting ball 10 is airborne after the impact), rolling time (the amount of time that the sporting ball 10 rolls on a ground surface 16 after landing on the ground surface after the impact), time between strikes of the sports ball 10, and the like. Other geolocation sensor systems or protocols may be utilized, such as LE, WiFi, Zibgee, Zwave, LoRa, and the like.

Figure 4:
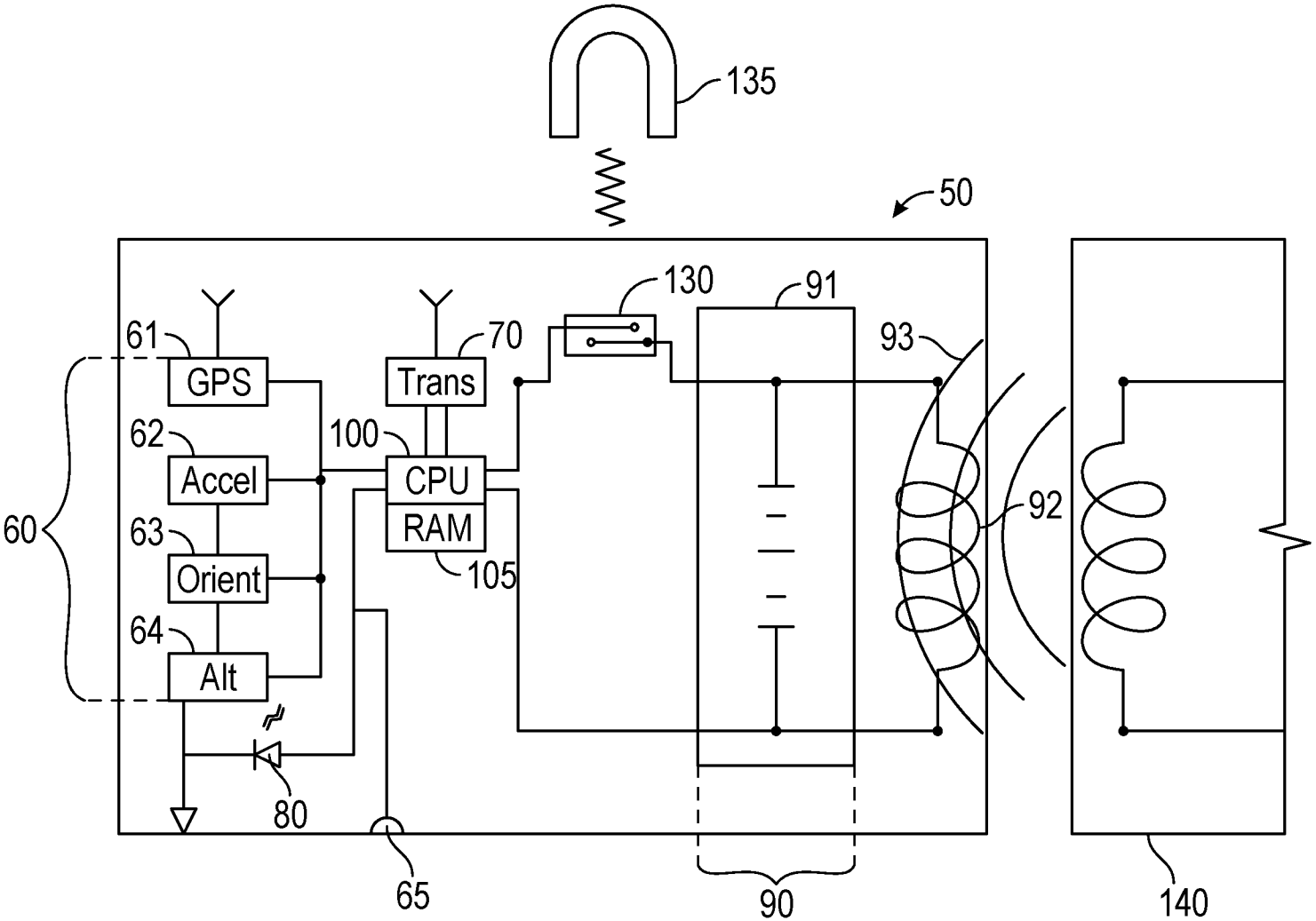
FIG. 4 is a diagram of the components of an electrical circuit of the sports ball.

The multi-axis accelerometer 62, preferably at least a 3-axis accelerometer 62, is adapted to report acceleration forces experience by the sports ball 10 in three dimensions, and through integrating the data determine velocity and distance traveled. Further, G-forces experienced by the sports ball 10 due to impact with the sporting implement 18 and the ground surface 16 are measured and stored in a non-volatile memory 105 of the electronic circuit 50 by a processor 100 of the electronic circuit 50 (FIG. 4).

The orientation sensor 63, preferably a 3-axis orientation sensor 63, is adapted to report the orientation of the sports ball 10, as well as the magnitude and direction of spin of the sports ball 10. The orientation sensor 63 may include a magnetometer for determining absolute direction of travel of the sports ball 10.

The altitude sensor 64, such as a barometer or the like, is adapted for determining altitude change of the sports ball 10 after impact with the sporting implement 18 and change-of-elevation between the impact and coming to rest on the ground surface 16.

The power source 90 preferably includes a rechargeable battery 91 electrically connected with an induction coil 92 fixed proximate the shell 30 and an outer surface 49 of the resilient core 40, such that an inductive energy field applied proximate the sports ball 10 results in the induction coil 92 recharging the battery 91.

The microphone 65 is adapted to detect the impact of the sporting implement 18 with the sports ball 10 and characterize the sound of the impact of landing to differentiate between hitting, for example, a tree vs. a fairway.

Preferably the electronic circuit 50 further includes a magnetic switch 130 proximate the resilient shell 30 and configured to deactivate the electronic circuit 50 when in proximity to a magnet 135. The induction coil 92 still recharges the battery 91 when the magnetic switch 130 is open.

All of the sensors 60 may be fixed with a circuit board and incorporated into a single package suitable for sustaining large G-forces, or may be distributed throughout the inner core 46 with resilient and durable wiring (not shown). Regardless, the electronic circuit 50 and its components are preferably positioned within the resilient core 40 such that a center of gravity $CG_E$ of the electronic circuit 50 substantially coincides with the center of gravity of the shell 30 and resilient core 40, such that wobbling of the sports ball 10 while in flight is minimized. Where that cannot be done, a center-of-gravity indicia 120 is applied to the resilient shell 30 at a point substantially aligned with an axis line $A_1$ that traverses through both the center of gravity $CG_E$ of the electronic circuit 50 and a center of gravity $CG_B$ of the rest of the sports ball 10 (FIG. 2).

Figure 5:
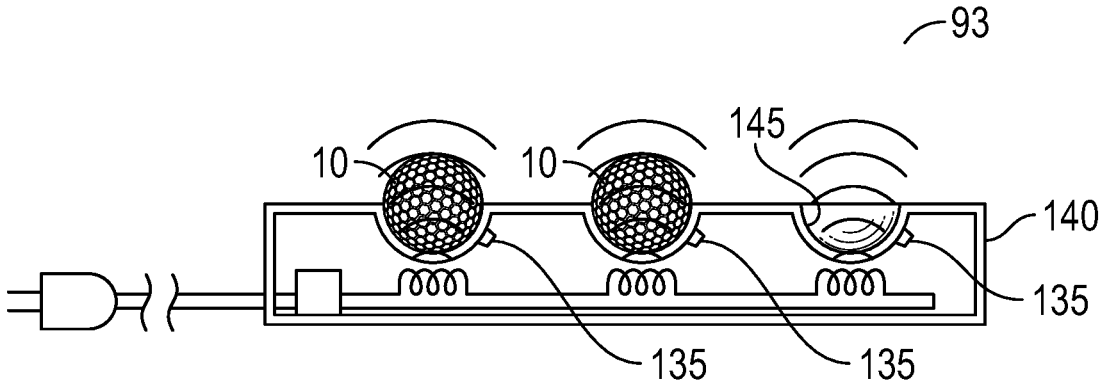
FIG. 5 is a cross-sectional view of a recharging base for the sports ball.

A recharging base 140 (FIG. 5) may be included and configured for receiving the resilient shell 30 within a ball well 145 therein. The recharging base 140 includes the inductive energy field 135 for recharging the battery 91 and, in some embodiments, the magnet 135 for deactivating the electronic circuit 50 while the sports ball 10 is retained in the recharging base 140 and charging. In some other embodiments wherein the electronic circuit remains active while charging the battery 91 in the recharging base 140, the LED 80 flashes when the battery 91 is charging, and glows steady when the battery 91 is fully charged.

Figure 6:
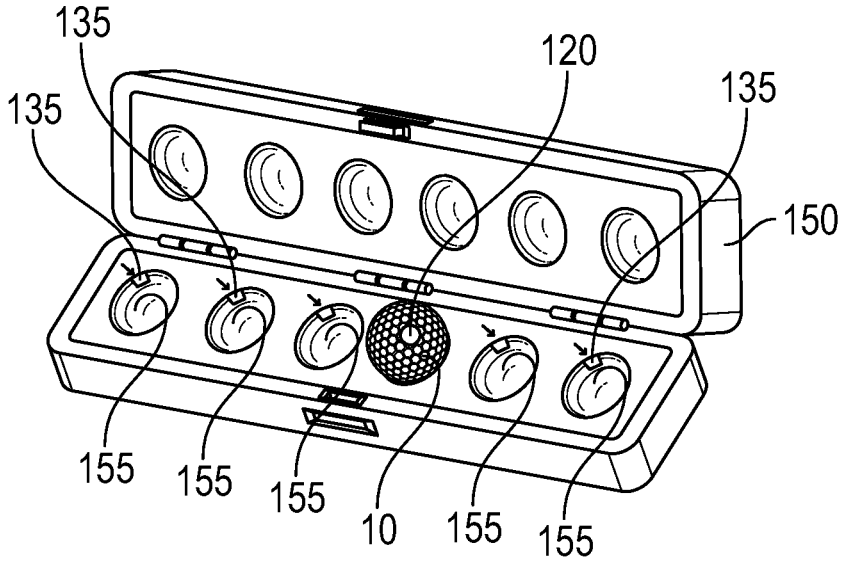
FIG. 6 is a perspective view of a transport package of the sports ball.

Optionally, a transport package 150 (FIG. 6) may be included and configured for holding a plurality of the sports balls 10 for transport from the recharging base 140 to the golf course. Such a transport package 150 includes one of the magnets 135 for each sports ball 10 held within the package 150, such that while the sports balls 10 are transported their electronic circuits 50 are all deactivated, whereby battery life is preserved.

One method of manufacturing the sports ball 10 comprises the steps of a) providing a two-piece resilient shell 30, the resilient core 40 fixed within the shell 30, and the electronic circuit 50; b) applying a center-of-gravity indicia 120 to a first piece 31 of the two-piece resilient shell 30; c) affixing the electronic circuit 50 and resilient core 40 together within the first piece 31 of the two-piece resilient shell 30, the electronic circuit 50 positioned so that an axis line $A_1$ through both the center of the resilient core 40 and the center of gravity $CG_E$ of the electronic circuit is aligned with the center-of-gravity indicia 120; and then d) sealing a second piece 32 of the two-piece resilient shell 30 around the resilient core 40 and electronic circuit 50. In such a method a seam 35 is formed between the first and second pieces 31,32 of the shell 30, such a seam 35 being abraded or cleaned so as to be minimally discernable.

Figure 7:
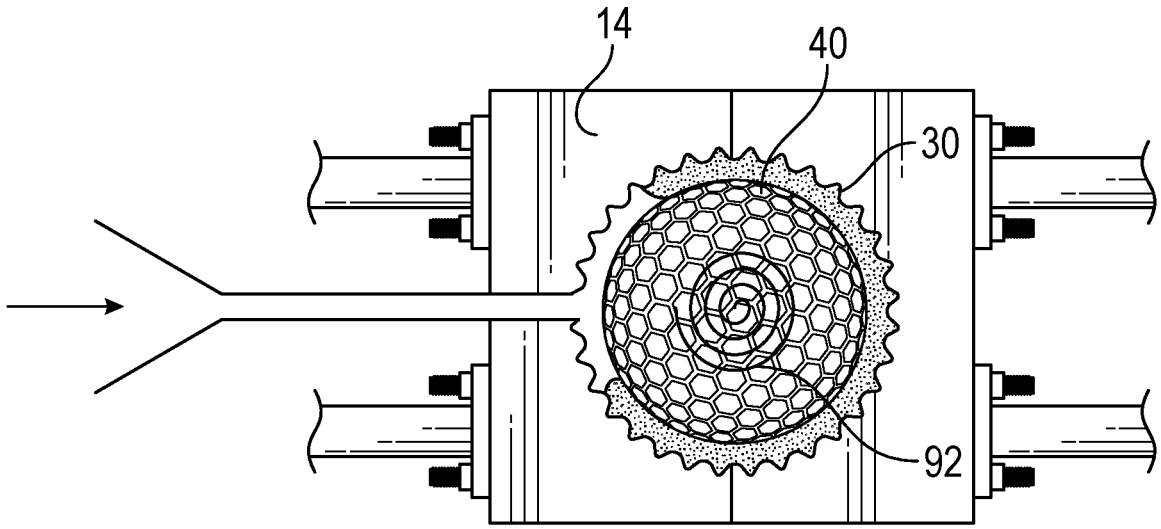
FIG. 7 is a diagram of an injection mold for forming the sports ball.
Figure 8:
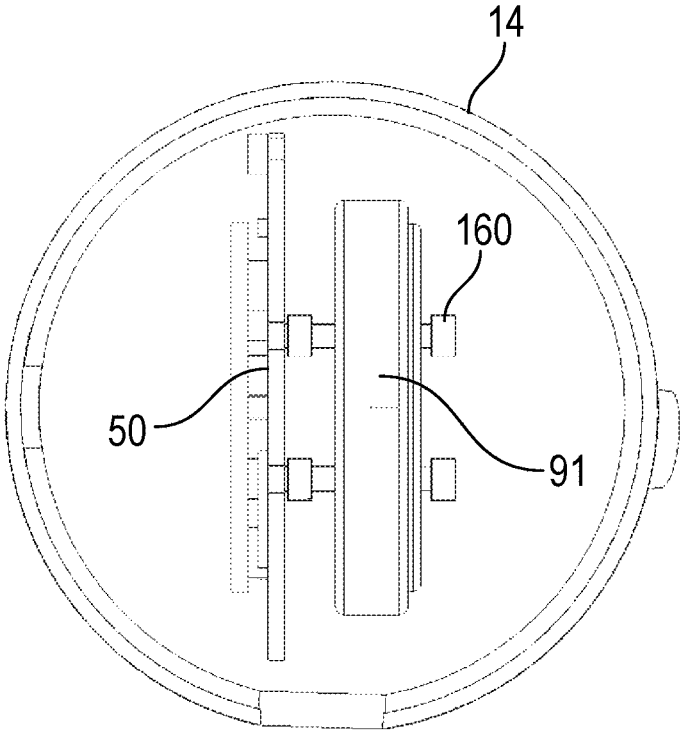
FIG. 8 is a diagram of an alternate injection mold for forming the sports ball.

Alternately, in a molding process, the sports ball 10 may be manufactured with the steps of a) providing the resilient core 40 and the electronic circuit 50; b) aligning the resilient core 40 and electronic circuit 50 within a mold 14 (FIG. 7); c) injecting molten plastic material around the resilient core 40 and electronic circuit 50 to form the resilient shell 30; and applying the center-of-gravity indicia 120 to the resilient shell 30 so that the axis line $A_1$ through both the center of the resilient core 40 and the center of gravity $CG_E$ of the electronic circuit 50 is aligned with the center-of-gravity indicia 120. FIG. 8 illustrates a diagram of a mold 14 in which is suspended the electronic circuit 50 and the battery 91 mutually attached with weight-balancing spacers 160, illustrated before the core 40 is injected therearound.

The sports ball 10 may be used in a driving range-type application wherein the transmitter 70 is an RFID circuit that transmits its ID and sensor data to receiving antennas in the driving range field of play. Such driving ranges typically provide feedback to the user as to the distance the ball 10 was hit and what target (not shown) in the range was hit. Sensor data from the at least one sensor 60 may also include measurements of spin speed and direction, peak height, and air hang-time, for example.

On a golf course, upon the external electronic device 20 becoming within range of the transmitter 70 of the electronic circuit 50, the sports ball 10 can report its position, distance hit, a measurement of spin speed and direction of the sports ball, peak height, air flight-time, type of surface hit with the sports ball 10 upon landing, roll distance after landing, swing strength, and the like. On a putting green, the sports ball 10 can have less durable sensors 60 that have greater resolution and sensitivity, since the g-forces experienced by the sports ball 10 on a putting green are significantly less than those experienced by sports balls 10 in the tee box or on the fairway.

While a particular form of the invention has been illustrated and described, it will be apparent that various modifications can be made without departing from the spirit and scope of the invention. For example, the sports ball 10 described herein and in the drawings generally reflect a golf-ball embodiment of the sports ball 10. However, the sports ball 10 can also be incorporated into other types of sporting balls and objects, such as a tennis ball, volleyball, baseball, basketball, football, soccer ball, bowling ball, flying disk, archery arrow, javelin, or the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A sports ball for communicating parameters to an external electronic device related to an impact of the sports ball by a sporting implement, comprising:

a resilient shell;

a resilient core fixed within the shell;

an electronic circuit including at least one sensor, a transmitter, and a power source, the electronic circuit adapted for communicating sensor data to the external electronic device via the transmitter and cushioned from the impact of the sporting implement by the resilient core; and a transport package configured for holding a plurality of the sports balls and that includes a magnet for each sports ball held therewith, whereby while the sports ball is transported the electronic circuit is deactivated by the respective magnet, preserving battery life, wherein the at least one sensor includes a multi-axis accelerometer adapted to report acceleration forces experienced by the sports ball in three dimensions;

the at least one sensor includes an orientation sensor adapted to measure a spin speed and spin direction of the sports ball;

the parameters include the acceleration forces experienced by the sports ball in three dimensions, the spin speed of the sports ball, and the spin direction of the sports ball; and the multi-axis accelerometer is a 9-axis accelerometer.

2. The sports ball of claim 1 wherein the resilient core includes an outer core and an inner core, the inner core being more resilient than the outer core.

3. The sports ball of claim 1 wherein the at least one sensor includes a GPS receiver, whereby the location of the sports ball can be transmitted to the external electronic device via the transmitter.

4. The sports ball of claim 1 wherein the power source is a rechargeable battery that is electrically connected with an induction coil fixed proximate the shell and an outer surface of the resilient core, whereby an inductive energy field applied proximate the sports ball results in the induction coil recharging the battery.

5. The sports ball of claim 1 wherein the electronic circuit further includes a light-emitting diode fixed proximate the shell and adapted to illuminate through the shell to indicate states of the electronic circuit, the shell being made from a non-opaque material.

6. The sports ball of claim 1 wherein the electronic circuit is positioned within the resilient core such that the center of gravity of the electronic circuit coincides with the center of gravity of the shell and resilient core.

7. The sports ball of claim 1 wherein the electronic circuit further includes a microphone for determining the impact of the sports ball by the sporting implement.

8. The sports ball of claim 1 wherein the electronic circuit further includes an altitude sensor for determining the elevation of the sports ball.

9. The sports ball of claim 8 wherein the altitude sensor is a barometer.

10. The sports ball of claim 1 wherein the resilient shell includes a center-of-gravity indicia substantially aligned with an axis line through both the center of the sports ball and the center of gravity of the sports ball.

11. The sports ball of claim 4 wherein the electronic circuit further includes a magnetic switch proximate the resilient shell, the magnetic switch configured to deactivate the electronic circuit when in proximity to the magnet, the induction coil recharging the battery regardless of the position of the magnetic switch.

12. The sports ball of claim 11 further including a recharging base configured for receiving the resilient shell within a ball well therein, the recharging base including the inductive energy field for recharging the battery and the magnet for deactivating the electronic circuit.

13. A method of manufacturing a sports ball that communicates parameters to an external electronic device related to an impact of the sports ball by a sporting implement, comprising the steps:

providing a two-piece resilient shell, a resilient core fixed within the shell, and an electronic circuit including at least one sensor, a transmitter, and a power source, the electronic circuit adapted for communicating sensor data to the external electronic device via the transmitter and cushioned from the impact of the sporting implement by the resilient core;

applying a center-of-gravity indicia to a first piece of the two-piece resilient shell;

affixing the electronic circuit and resilient core together within the first piece of the two-piece resilient shell, the electronic circuit positioned so that an axis line through both the center of the resilient core and the center of gravity of the electronic circuit is aligned with the center-of-gravity indicia;

sealing a second piece of the two-piece resilient shell around the resilient core and electronic circuit; and providing a transport package for holding a plurality of the manufactured sports balls, wherein a magnet is provided for each sports ball held therewith, whereby while the sports ball is transported the electronic circuit is deactivated by the respective magnet, preserving battery life, wherein the at least one sensor includes a multi-axis accelerometer adapted to report acceleration forces experienced by the sports ball in three dimensions; and the at least one sensor includes an orientation sensor adapted to measure a spin speed and spin direction of the sports ball.

14. A method of manufacturing a sports ball that communicates parameters to an external electronic device related to an impact of the sports ball by a sporting implement, comprising the steps:

providing a resilient core and an electronic circuit including at least one sensor, a transmitter, and a power source, the electronic circuit adapted for communicating sensor data to the external electronic device via the transmitter and cushioned from the impact of the sporting implement by the resilient core;

aligning the resilient core and electronic circuit within a mold for forming a resilient shell;

injecting molten plastic material around the resilient core and electronic circuit;

applying a center-of-gravity indicia to the resilient shell so that an axis line through both the center of the resilient core and the center of gravity of the electronic circuit is aligned with the center-of-gravity indicia; and providing a transport package for holding a plurality of the manufactured sports balls, wherein a magnet is provided for each sports ball held therewith, whereby while the sports ball is transported the electronic circuit is deactivated by the respective magnet, preserving battery life, wherein the at least one sensor includes a multi-axis accelerometer adapted to report acceleration forces experienced by the sports ball in three dimensions; and the at least one sensor includes an orientation sensor adapted to measure a spin speed and spin direction of the sports ball.

* * * * *